US011079164B2

(12) United States Patent
Jeong et al.

(10) Patent No.: US 11,079,164 B2
(45) Date of Patent: Aug. 3, 2021

(54) REFRIGERATOR

(71) Applicant: SAMSUNG ELECTRONICS CO., LTD., Suwon-si (KR)

(72) Inventors: Jin Jeong, Yongin-si (KR); Bong Su Son, Cheonan-si (KR); Do Yun Jang, Suwon-si (KR); Yeon Woo Cho, Seoul (KR); Yong Jong Park, Seongnam-si (KR); Kook Jeong Seo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 29 days.

(21) Appl. No.: 15/982,273

(22) Filed: May 17, 2018

(65) Prior Publication Data

US 2018/0335246 A1 Nov. 22, 2018

(30) Foreign Application Priority Data

May 18, 2017 (KR) ..... 10-2017-0061754

(51) Int. Cl.
*F25D 23/02* (2006.01)
*F25C 5/20* (2018.01)
(Continued)

(52) U.S. Cl.
CPC ..... *F25D 23/025* (2013.01); *F25C 5/185* (2013.01); *F25C 5/22* (2018.01); *F25D 23/028* (2013.01);
(Continued)

(58) Field of Classification Search
CPC .... F25D 23/025; F25D 23/028; F25D 23/126; F25D 23/04; F25D 2323/024; F25D 2323/121; F25C 5/22; F25C 5/185
See application file for complete search history.

(56) References Cited

U.S. PATENT DOCUMENTS 8,745,992 B2 * 6/2014 Cheong ..... F25D 23/025 62/3.3
10,174,987 B2 * 1/2019 Im ..... F25B 39/00
(Continued)

FOREIGN PATENT DOCUMENTS

EP 3096097 A1 * 11/2016 ..... F25D 11/02
KR 2003-0083812 11/2003
(Continued)

OTHER PUBLICATIONS

PCT International Search Report issued in PCT International Application No. PCT/KR2018/005601 dated Sep. 19, 2018 (3 pages total).
(Continued)

*Primary Examiner* — Gordon A Jones
(74) *Attorney, Agent, or Firm* — Staas & Halsey LLP

(57) ABSTRACT

A refrigerator includes a body configured to include a storage compartment, a door portion configured to include an inner door pivotably coupled to the body to open/close the storage compartment and an outer door pivotably provided in front of the inner door, an ice making chamber formed at the door portion to be divided from the storage compartment by the inner door and to be opened or closed by the outer door, an ice making system accommodated in the ice making chamber, a dispenser provided at the door portion to provide water and ice, and a water filter mountable at the door portion to purify water supplied from an external water supply source. The ice making chamber is easily accessible by opening only the outer door while the inner door is closed and prevent cold air in the storage compartment from flowing out.

13 Claims, 10 Drawing Sheets

(51) Int. Cl.
*F25C 5/185* (2018.01)
*F25D 23/12* (2006.01)
*F25D 23/04* (2006.01)

(52) U.S. Cl.
CPC ..... *F25D 23/126* (2013.01); *F25D 23/04* (2013.01); *F25D 2323/024* (2013.01); *F25D 2323/121* (2013.01); *F25D 2600/04* (2013.01)

(56) References Cited

U.S. PATENT DOCUMENTS

2005/0229623 A1* 10/2005 Kim ..... B67D 1/0858 62/389
2006/0196214 A1* 9/2006 Lee ..... F25D 17/065 62/344
2007/0012611 A1* 1/2007 An ..... F25D 23/126 210/232
2010/0313594 A1 12/2010 Lee et al.
2012/0006046 A1* 1/2012 An ..... F25C 1/00 62/318
2012/0060540 A1* 3/2012 Yang ..... F25D 23/04 62/340
2012/0096872 A1* 4/2012 Cheong ..... F25D 23/025 62/3.3
2012/0285192 A1* 11/2012 Mitchell ..... B01D 27/00 62/318
2012/0297814 A1 11/2012 Kim et al.
2014/0150473 A1 6/2014 Boarman et al.
2014/0182324 A1 7/2014 Lee et al.
2016/0003523 A1* 1/2016 Kim ..... B01F 15/00155 222/146.6
2016/0084560 A1* 3/2016 Jeong ..... F25D 11/02 62/344
2016/0116199 A1* 4/2016 Fischer ..... F25C 5/185 62/344
2016/0370102 A1 12/2016 Yang
2017/0167780 A1 6/2017 Jeong et al.
2018/0187964 A1* 7/2018 Park ..... F25D 23/02
2018/0328641 A1* 11/2018 Lee ..... F25D 17/065
2019/0024962 A1* 1/2019 Lee ..... E05D 11/00
2019/0285337 A1* 9/2019 Kim ..... D06F 39/14

FOREIGN PATENT DOCUMENTS

KR 2003-0092871 12/2003
KR 10-2006-0062664 6/2006
KR 10-2011-0072367 6/2011
KR 10-2012-0040891 4/2012
KR 10-2015-0107232 9/2015
KR 10-2015-0107232 A 9/2015
WO 2017/039333 A1 3/2017

OTHER PUBLICATIONS

Extended European Search Report dated Apr. 15, 2020, in corresponding European Patent Application No. 18802032.5.
Chinese Office Action dated Mar. 3, 2021, in corresponding Chinese Patent Application No. 201880047958.2.
Korean Office Action dated Apr. 28, 2021, in corresponding Korean Patent Application No. 10-2017-0061754.

* cited by examiner

REFRIGERATOR

CROSS-REFERENCE TO RELATED APPLICATION

This application claims the benefit of Korean Patent Application No. 10-2017-0061754, filed on May 18, 2017 in the Korean Intellectual Property Office, the disclosure of which is incorporated herein by reference.

BACKGROUND

1. Field

Embodiments of the present disclosure relate to a refrigerator in which an ice making chamber is provided in a door.

2. Description of the Related Art

A refrigerator is a home appliance which includes a body having a storage compartment, a cold air supply device configured to supply cold air to the storage compartment, and a door configured to open or close the storage compartment to store food in a fresh state.

The refrigerator also includes an ice making chamber for making and storing ice. In the case of bottom mounted freezer (BMF) refrigerators, an ice making chamber may generally be provided at one corner inside a refrigerator compartment or provided at a rear side of a refrigerator compartment door. In the ice making chamber, an ice maker for making ice and an ice bucket configured to store and transfer the made ice to a dispenser may be arranged.

As described above, when the ice making chamber is provided at one corner inside the refrigerator compartment or provided at the rear side of the refrigerator compartment door, it is necessary to open the door to approach or access the ice maker and the ice bucket arranged in the ice making chamber.

SUMMARY

Therefore, it is an aspect of the present disclosure to provide a refrigerator in which it is easy to approach or access an ice making chamber.

It is another aspect of the present disclosure to provide a refrigerator in which cold air in a storage compartment is prevented from flowing out while an ice making chamber is approached or being accessed.

It is still another aspect of the present disclosure to provide a refrigerator in which a water filter is easily replaced and maintained and a water supply pipe is simplified.

Additional aspects of the present disclosure will be set forth in part in the description which follows and, in part, will be apparent from the description, or may be learned by practice of the present disclosure.

In accordance with one aspect of the present disclosure, a refrigerator includes a body configured to include a storage compartment, a door portion configured to include an inner door pivotably coupled to the body to open or close the storage compartment and an outer door pivotably provided in front of the inner door, an ice making chamber formed at the door portion to be divided from the storage compartment by the inner door and to be opened or closed by the outer door, an ice making system accommodated in the ice making chamber, a dispenser provided at the door portion to provide water and ice, and a water filter mountable at the door portion to purify water supplied from an external water supply source.

The ice making chamber may be formed at a front side of the inner door.

The ice making chamber may be formed at a rear side of the outer door.

The ice making system may include an ice maker provided in the ice making chamber to make ice, an ice bucket configured to store the ice, and an auger motor configured to stir or transfer the ice stored in the ice bucket.

The door portion may include a gasket provided between the inner door and the outer door to seal the ice making chamber.

The inner door may include a water filter accommodation portion configured to accommodate the water filter.

The water filter accommodation portion may be formed at a front side of the inner door to be accessible when the inner door is closed.

The refrigerator may further include a hinge member configured to pivotably couple the inner door to the body and a water supply pipe configured to guide the water supplied from the external water supply source to the water filter when the water filter is accommodated in the water filter accommodation portion. Here, the water supply pipe may be connected to the water filter when the water filter is accommodated in the water filter accommodation portion through the hinge member.

The hinge member may include a hinge shaft. The inner door may include a hinge groove in which the hinge shaft is inserted. The inner door may be configured to pivot with respect to the hinge shaft. The hinge shaft may include a through hole through which the water supply pipe passes.

The outer door may include a water filter accommodation portion configured to accommodate the water filter.

The dispenser may be formed at the inner door.

An opening may be formed at the outer door such that the dispenser is accessible when the outer door is closed.

The dispenser may be formed at the outer door.

The dispenser may include a dispensing space through which the water and ice are discharged. The door portion may include a chute configured to connect the ice making chamber to the dispensing space to guide ice in the ice making chamber to the dispensing space. The chute may include an internal chute formed at the inner door and an external chute formed at the outer door. The internal chute and the external chute may be configured to communicate with each other when the outer door is closed.

The refrigerator may further include a water tank configured to store and refrigerate the water purified by the water filter when the water filter is accommodated in the water filter accommodation portion. Here, the inner door may include a water tank accommodation portion formed at a rear side of the inner door to communicate with the storage compartment.

In accordance with another aspect of the present disclosure, a refrigerator includes a body configured to include a storage compartment, an inner door pivotably coupled to the body to open or close the storage compartment, an ice making chamber formed at a front side of the inner door to be divided from the storage compartment by the inner door and in which an ice making system accommodated in the ice making chamber, a dispenser provided at the front side of the inner door to provide water and ice, and an outer door pivotably coupled to the body and provided in front of the inner door to be pivotable in a same direction as a direction that the inner door opens or closes the ice making chamber.

Here, the outer door has a size corresponding to a size of the inner door and includes an opening to allow the dispenser to be accessible when the outer door is closed.

The refrigerator may further include a water filter mountable at the inner door and configured to purify water supplied form an external water supply source. Here, the inner door may include a water filter accommodation portion configured to accommodate the water filter. Also, the water filter accommodation portion may be formed at the front side of the inner door to be accessible when the inner door is closed.

The refrigerator may further include a hinge member configured to pivotably couple the inner door to the body and a water supply pipe configured to guide the water supplied from the external water supply source to the water filter. Here, the water supply pipe may be connected to the water filter through the hinge member.

The refrigerator may further include a water tank configured to store and refrigerate the water purified by the water filter. Here, the inner door may include a water tank accommodation portion in which the water tank is accommodated. Also, the water tank accommodation portion may be formed at a rear side of the inner door to communicate with the storage compartment.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Since embodiments disclosed in the specification are merely preferable examples of the present disclosure and do not represent the entire technical concept of the present disclosure, it should be understood that a variety of equivalents or modifications capable of replacing the embodiments and made at the time of filing the present application are included in the scope of the present disclosure.

Hereinafter, exemplary embodiments of the present disclosure will be described in detail with reference to the attached drawings.

Figure 1:
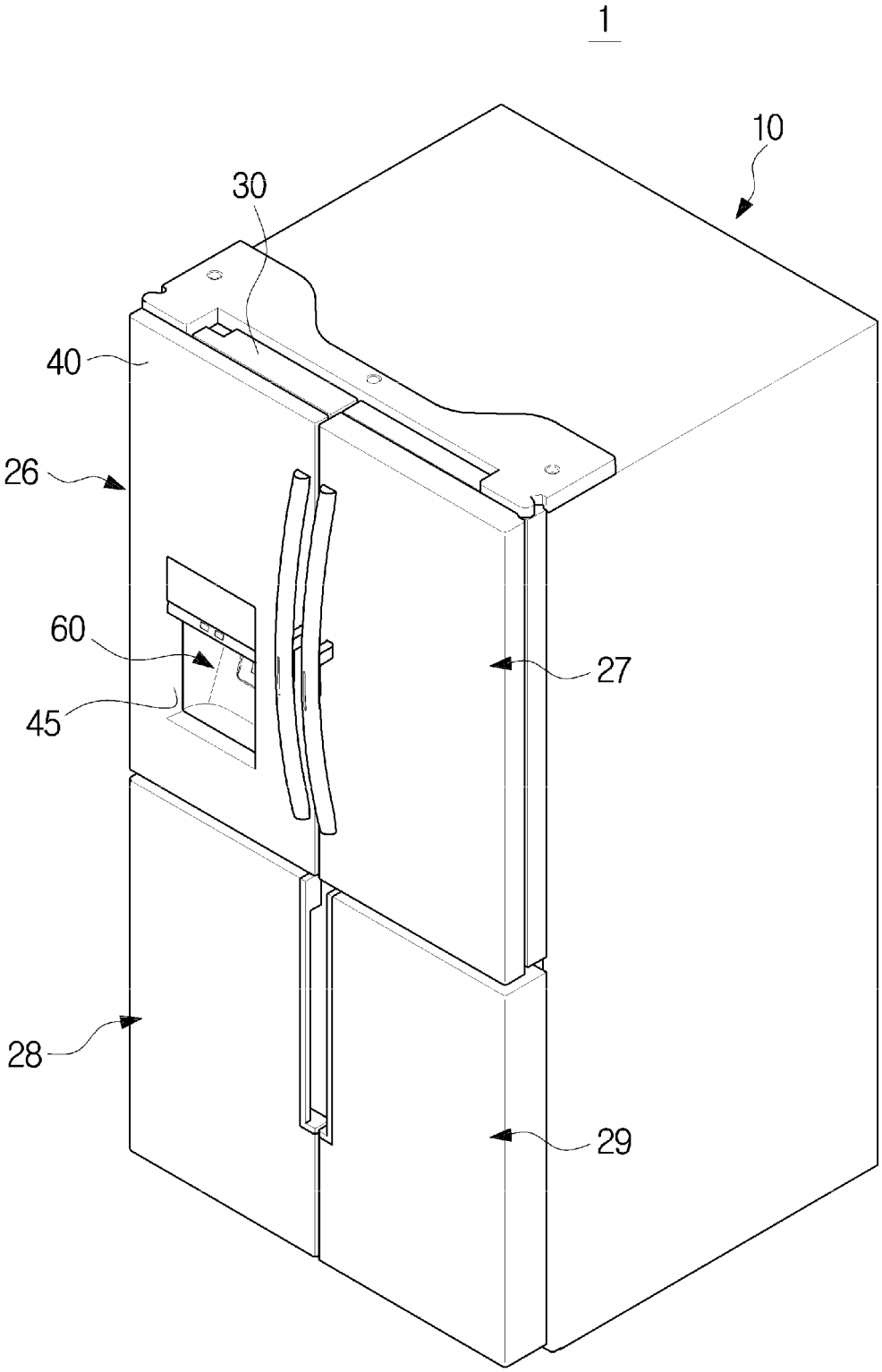
FIG. 1 is a perspective view of a refrigerator according to a first embodiment of the present disclosure.
Figure 2:
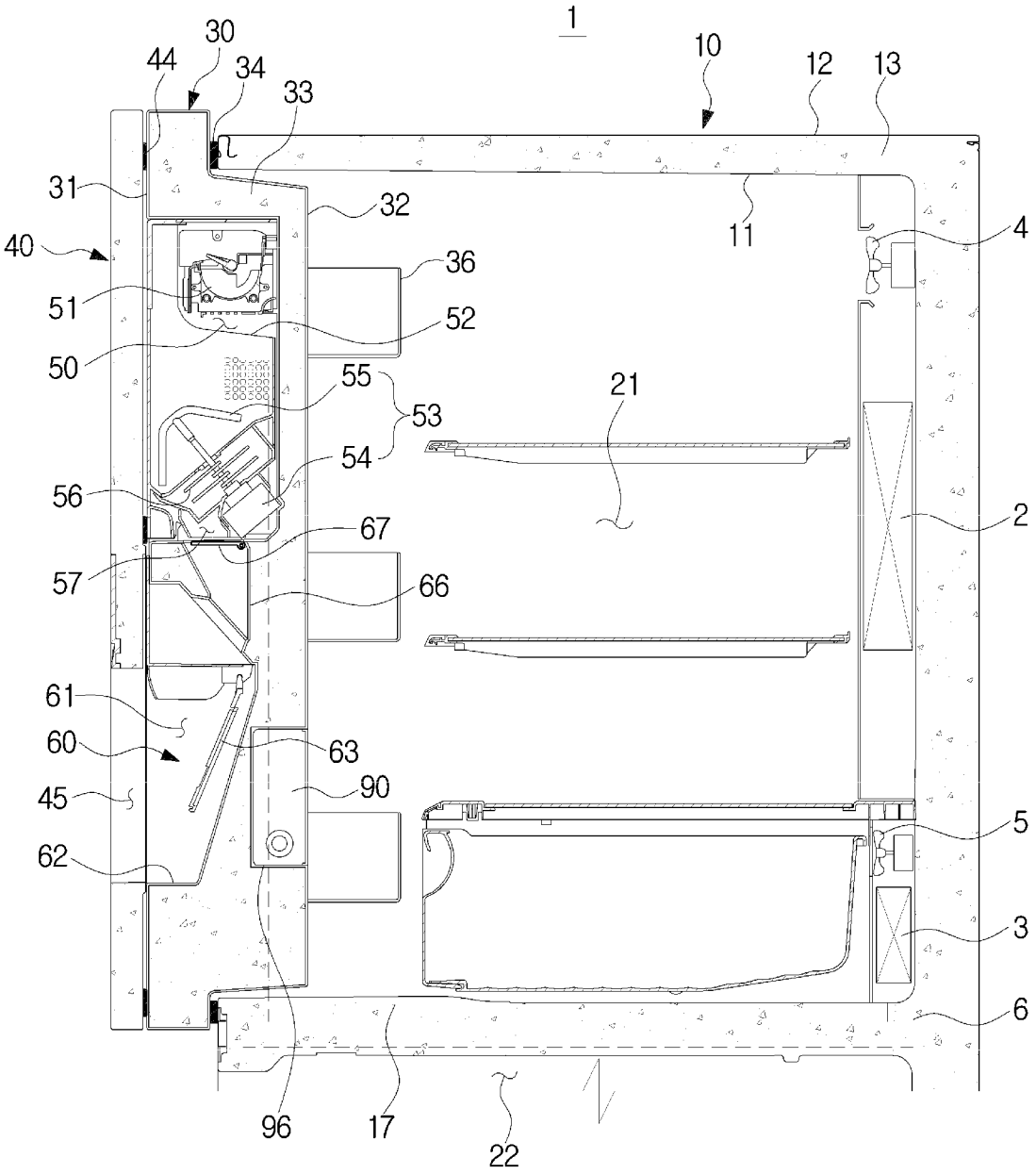
FIG. 2 is a side cross-sectional view schematically illustrating main components of the refrigerator of FIG. 1.
Figure 3:
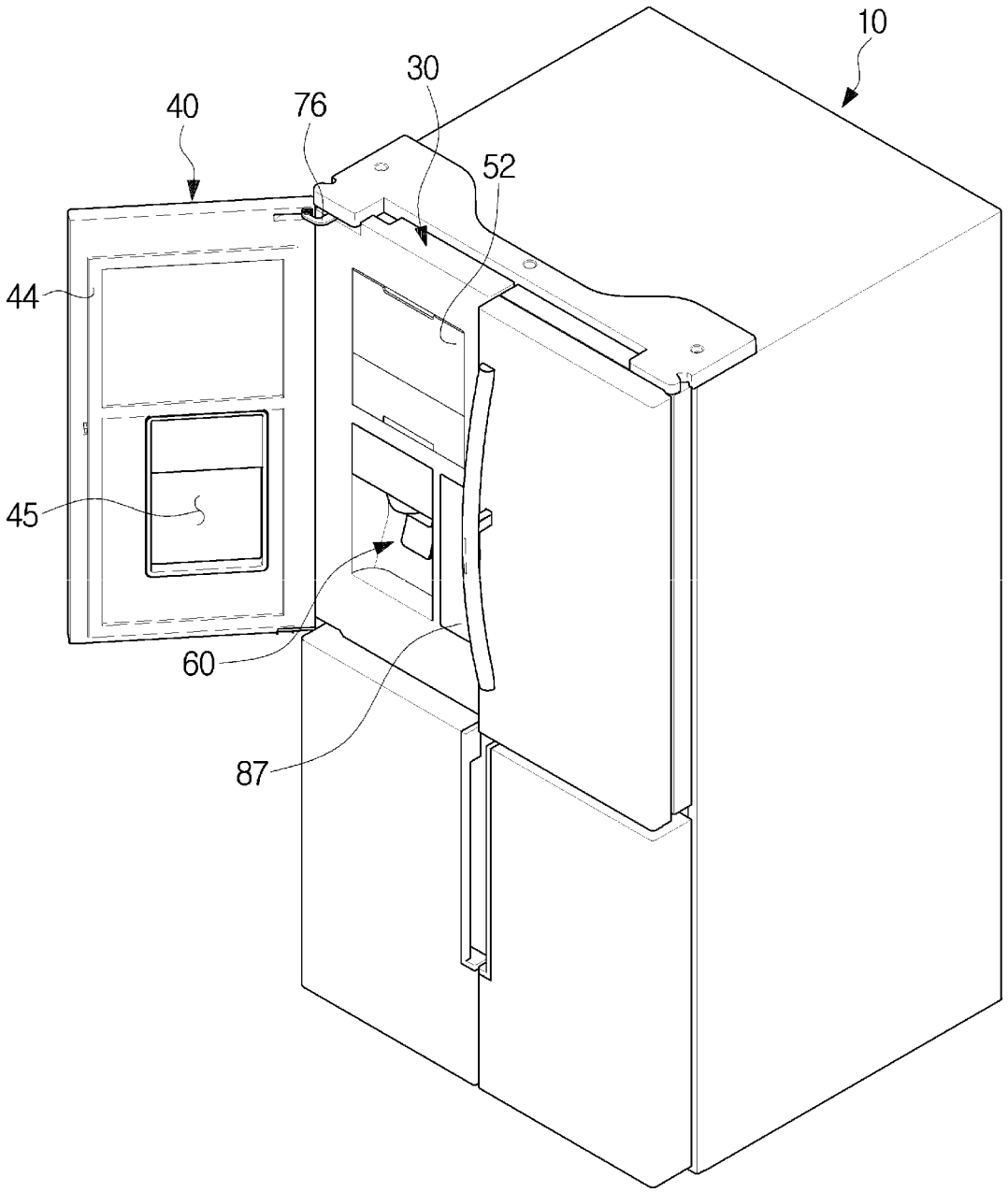
FIG. 3 is a view illustrating a state in which an outer door of the refrigerator of FIG. 1 is opened.
Figure 4:
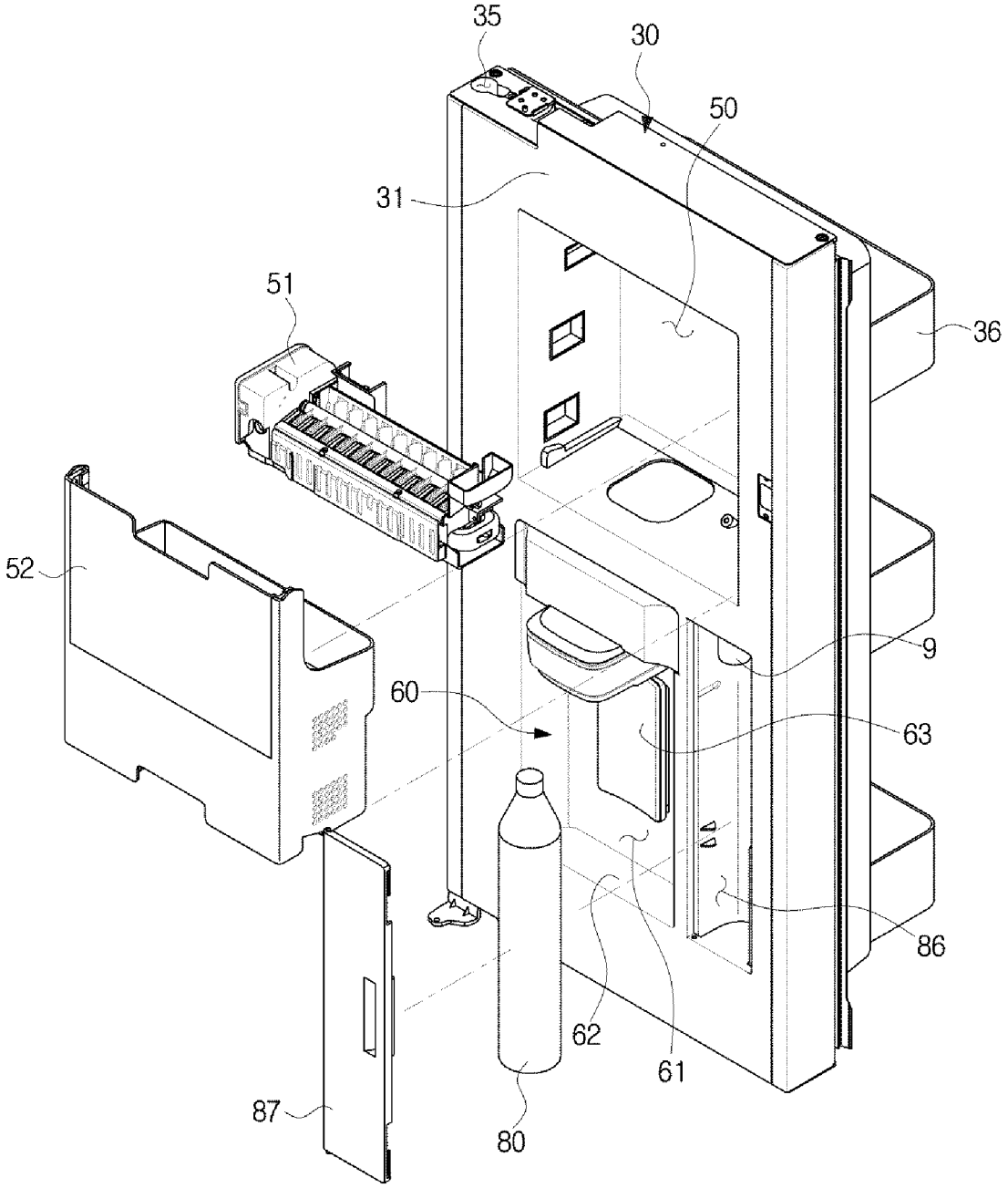
FIG. 4 is an enlarged view illustrating a door portion of the refrigerator of FIG. 1.
Figure 5:
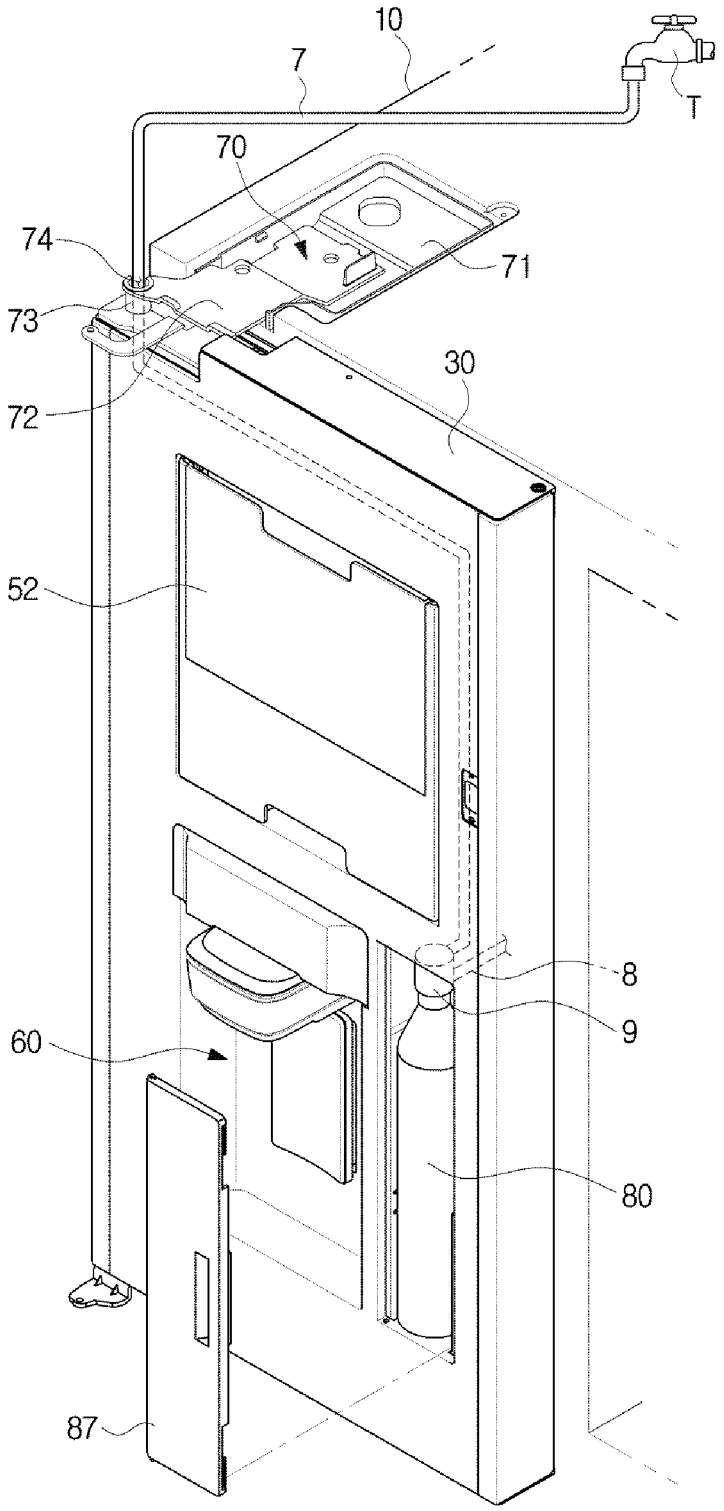
FIG. 5 is a view illustrating a water supply pipe configured to connect an external water supply source and a water filter of the refrigerator of FIG. 1.

FIG. 1 is a perspective view of a refrigerator according to a first embodiment of the present disclosure. FIG. 2 is a side cross-sectional view schematically illustrating main components of the refrigerator of FIG. 1. FIG. 3 is a view illustrating a state in which an outer door of the refrigerator of FIG. 1 is opened. FIG. 4 is an enlarged view illustrating a door portion of the refrigerator of FIG. 1. FIG. 5 is a view illustrating a water supply pipe configured to connect an external water supply source and a water filter of the refrigerator of FIG. 1.

Referring to FIGS. 1 to 5, a refrigerator 1 may include a body 10 including storage compartments 21 and 22, door portions 26, 27, 28, and 29 provided in front of the storage compartments 21 and 22, an ice making chamber 50 provided at the door portion 26 to make and store ice, and a cold air supply device configured to supply cold air to the storage compartments 21 and 22.

The cold air supply device may include evaporators 2 and 3, a compressor 6, a condenser (not shown), and an expansion device (not shown) and may generate cold air using latent heat of evaporation of a refrigerant. Cold air generated at the evaporators 2 and 3 may be supplied to the storage compartment 21 and the ice making chamber 50 by air blowing fans 4 and 5 being operated. The refrigerator 1 may include a cold air duct 6 configured to connect the evaporator 3 to the ice making chamber 50 to supply the cold air generated at the evaporator 3 to the ice making chamber 50.

The body 10 may include an inner casing 11 which forms the storage compartments 21 and 22, an outer casing 12 coupled to an outside of the inner casing 11 to form an exterior of the refrigerator 1, and an insulator 13 provided between the inner casing 11 and the outer casing 12 to insulate the storage compartments 21 and 22. The inner casing 11 may be formed by a plastic material being injection-molded, and the outer casing 12 may be formed by a metal material. Urethane foam insulation may be used as the insulator 13, and a vacuum insulation panel may be used in addition thereto as necessary.

The body 10 may include an intermediate wall 17 such that the storage compartments 21 and 22 may be divided into an upper storage compartment 21 and a lower storage compartment 22 by the intermediate wall 17. The intermediate wall 17 may include an insulator, and the upper storage compartment 21 and the lower storage compartment may be insulated from each other.

The upper storage compartment 21 may be used as a refrigerator compartment configured to maintain a temperature of about 0 to 5° C. and store food in a refrigerated state, and the lower storage compartment 22 may be used as a freezer compartment configured to maintain a temperature of about −30 to 0° C. and store food in a frozen state.

The storage compartments 21 and 22 may include open front sides through which food is inserted or withdrawn, and the open front sides of the storage compartments 21 and 22 may be opened or closed by the door portions 26, 27, 28, and 29 pivotably provided in front of the storage compartments 21 and 22. The storage compartment 21 may be opened or closed by the door portions 26 and 27, and the storage compartment 22 may be opened or closed by the door portions 28 and 29.

The door portion 26 may include an inner door 30 pivotably coupled to the body 10 to open or close the storage compartment 21 and an outer door 40 pivotably provided in front of the inner door 30. The inner door 30 may be pivotably coupled to the body 10 through a hinge member 70. The outer door 40 may be pivotably coupled to the inner door 30 or pivotably coupled to the body 10 through a hinge member 76. Here, the outer door 40 may be independently open and close while the inner door 30 is closed. The inner door 30 and the outer door 40 may be configured to be pivotable in the same direction.

The outer door 40 may have a size corresponding to a size of the inner door 30. Accordingly, when both the inner door 30 and the outer door 40 are closed, only a dispenser 60 of the inner door 30 may be exposed through an opening 45 of the outer door 40, which will be described below, and other parts of the inner door 30 may be covered by the outer door 40 not to be exposed. In other words, the ice making chamber is accessible by opening the outer door 40 without opening the inner door 30.

The ice making chamber 50 may be provided at the door portion 26. In detail, the ice making chamber 50 may be formed at a front side of the inner door 30 to be divided, separated, and independent from the storage compartment 21 by the inner door 30. The inner door 30 may include a front plate 31, a rear plate 32 coupled behind the front plate 31, and an insulator 33 provided between the front plate 31 and the rear plate 32. The ice making chamber 50 may be formed of one area of the front plate 31 that is recessed toward the insulator 33. The ice making chamber 50 may be formed to have an open front side. The open front side of the ice making chamber 50 may be opened or closed by the outer door 40.

Like the insulator 13 of the body 10, urethane foam insulation may be used as the insulator 33, and a vacuum insulation panel may be used in addition thereto as necessary. The ice making chamber 50 may be insulated from the storage compartment 21 of the body 10 by the insulator 33.

An ice making system capable of making, storing, and transferring ice may be disposed in the ice making chamber 50. The ice making system may include an ice maker 51 configured to make ice by water being put therein to freeze, an ice bucket 52 configured to store the ice made by the ice maker 51, a transfer device 53 configured to transfer the ice stored in the ice bucket 52 to the dispenser 60, and an ice smashing blade 56 configured to smash the ice.

The transfer device 53 may include an auger motor 54 configured to generate a rotation force and a transfer member 55 configured to receive power from the auger motor 54 and be rotated to stir or transfer ice. The ice maker 51 may include an ice making cell capable of holding water and an ejector configured to move ice made by the ice making cell to the ice bucket 52.

The ice making system may include a full level sensor configured to sense a full level of the ice bucket 52. The ice making system may be configured to automatically perform a series of operations of water supplying, water freezing, ice moving, full-level sensing, stirring, smashing, and the like.

The transfer device 53 and the ice smashing blade 56 may be configured to be integrated with the ice bucket 52. An outlet 57 may be formed at a bottom of the ice bucket 52 to discharge stored ice to a chute 66, which will be described below.

Through the above configuration, a user may access the ice making chamber 50 and withdraw the ice bucket 52 by opening only the outer door 40 without needing to open the inner door 30. Accordingly, operations of withdrawing ice from the ice bucket 52 and maintaining, cleaning, and replacing the ice bucket 52, the auger motor 54, the transfer member 55, the ice smashing blade 56, and the like, which are attached to the ice bucket 52, may be easily performed.

Also, since the inner door 30 may remain in a closed state when the ice making chamber 50 is accessed, an outflow of cold air in the storage compartment 21 may be prevented and energy consumption may be reduced.

The inner door 30 may include the dispenser 60 configured to provide water and ice to the user. The dispenser 60 may include a dispensing space 61 formed to be recessed to receive water and ice, a dispensing tray 62 for disposing a container such as a cup and the like in the dispensing space 61, and a switch 63 for inputting an operation command for the dispenser 60.

The inner door 30 may include the chute 66 configured to connect the ice making chamber 50 to the dispensing space 61 to guide ice in the ice bucket 52 to the dispensing space 61. An opening or closing member 67 configured to normally close the chute 66 to prevent cold air in the ice making chamber 50 from flowing through the chute 66 and open the chute 66 to allow ice to pass therethrough while the dispenser 60 operates may be provided in the chute 66.

The outer door 40 may include the opening 45 to allow the dispenser 60 of the inner door 30 to be accessible while the outer door 40 is closed. The opening 45 may be formed at a position corresponding to the dispenser 60. The opening 45 may have an approximate quadrangular shape.

A door guard 36 capable of storing food may be provided on a rear side of the inner door 30. A gasket 34 in close contact with a front side of the body 10 may be provided on the rear side of the inner door 30 to seal the storage compartment 21, and a gasket 44 in close contact with the front side of the inner door 30 may be provided on a rear side of the outer door 40 to seal the ice making chamber 50.

The refrigerator 1 may include a water tank 90 configured to store and refrigerate water purified by a water filter 80. The inner door 30 may include a water tank accommodation portion 96 configured to accommodate the water tank 90. The water tank accommodation portion 96 may be formed on the rear side of the inner door 30 to communicate with the storage compartment 21. Accordingly, the cold air in the storage compartment 21 may flow into the water tank accommodation portion 96 such that the water stored in the water tank 90 may be refrigerated.

The refrigerator 1 may include the water filter 80 configured to purify water, a raw water supply pipe 7 (refer to FIG. 5) configured to guide water from an external water supply source T to the water filter 80, and a purified water supply pipe 8 (refer to FIG. 5) configured to guide the water purified by the water filter 80 to the water tank 90 or the ice maker 51.

A water filter accommodation portion 86 may be formed at the inner door 30 to accommodate the water filter 80. The water filter accommodation portion 86 may be formed on the front side of the inner door 30 to be accessible while the inner door 30 is closed and only the outer door 40 is opened. The water filter accommodation portion 86 is configured to have an open front side, and a water filter cover 87 may be detachably provided at the open front side of the water filter accommodation portion 86.

A water valve 9 on which the water filter 80 is mounted may be provided at the water filter accommodation portion 86. The raw water supply pipe 7 and the purified water supply pipe 8 may be connected to the water valve 9. When the water filter 80 is mounted on the water valve 9, water of the raw water supply pipe 7 may flow into the water filter 80 and the water purified by the water filter 80 may flow to the purified water supply pipe 8. The water valve 9 may be configured to cut off the raw water supply pipe 7 and the purified water supply pipe 8 to block a flow of water through the raw water supply pipe 7 and the purified water supply pipe 8 when the water filter 80 is separated from the water valve 9. The water valve 9 may have one of a variety of well-known structures.

The raw water supply pipe 7 may be connected to the water filter 80 through the hinge member 70 configured to pivotably couple the inner door 30 to the body 10.

The hinge member 70 may include a fixed portion 71 fixed to the body 10 and an extension portion 72 configured to extend frontward from the fixed portion 71. A hinge shaft 73 may protrude from the extension portion 72. The hinge shaft 73 may be inserted into a hinge groove 35 (refer to FIG. 4) formed at the inner door 30, and the inner door 30 may pivot on the hinge shaft 73. A through hole 74 through which the raw water supply pipe 7 passes may be formed at the hinge shaft 73.

Through this configuration, the raw water supply pipe 7 may be inserted into the inner door 30 through the through hole 74 of the hinge shaft 73, pass through the insulator 33 of the inner door 30, and be connected to the water filter 80 mounted in the inner door 30.

Since the water filter 80 is provided at the inner door 30 and the raw water supply pipe 7 configured to connect the external water supply source T to the water filter 80 is connected to the water filter 80 through the hinge member 70, a water supply pipe line may be simplified and water supply pipes may be easily connected.

The water purified by the water filter 80 may be supplied to the ice maker 51 to make ice or may be supplied to the water tank 90 to be kept refrigerated via the purified water supply pipe 8. A flow path switching valve (not shown) may be installed at the purified water supply pipe 8 to switch a flow direction of water to any one of the ice maker 51 and the water tank 90.

In the embodiment, since both the ice maker 51 and the water tank 90 are provided at the door portion 26, the purified water supply pipe 8 may be installed at only the door portion 26 and does not need to extend to the body 10. Accordingly, the water supply pipe line may be more simplified and the water supply pipes may be more easily connected.

Figure 6:
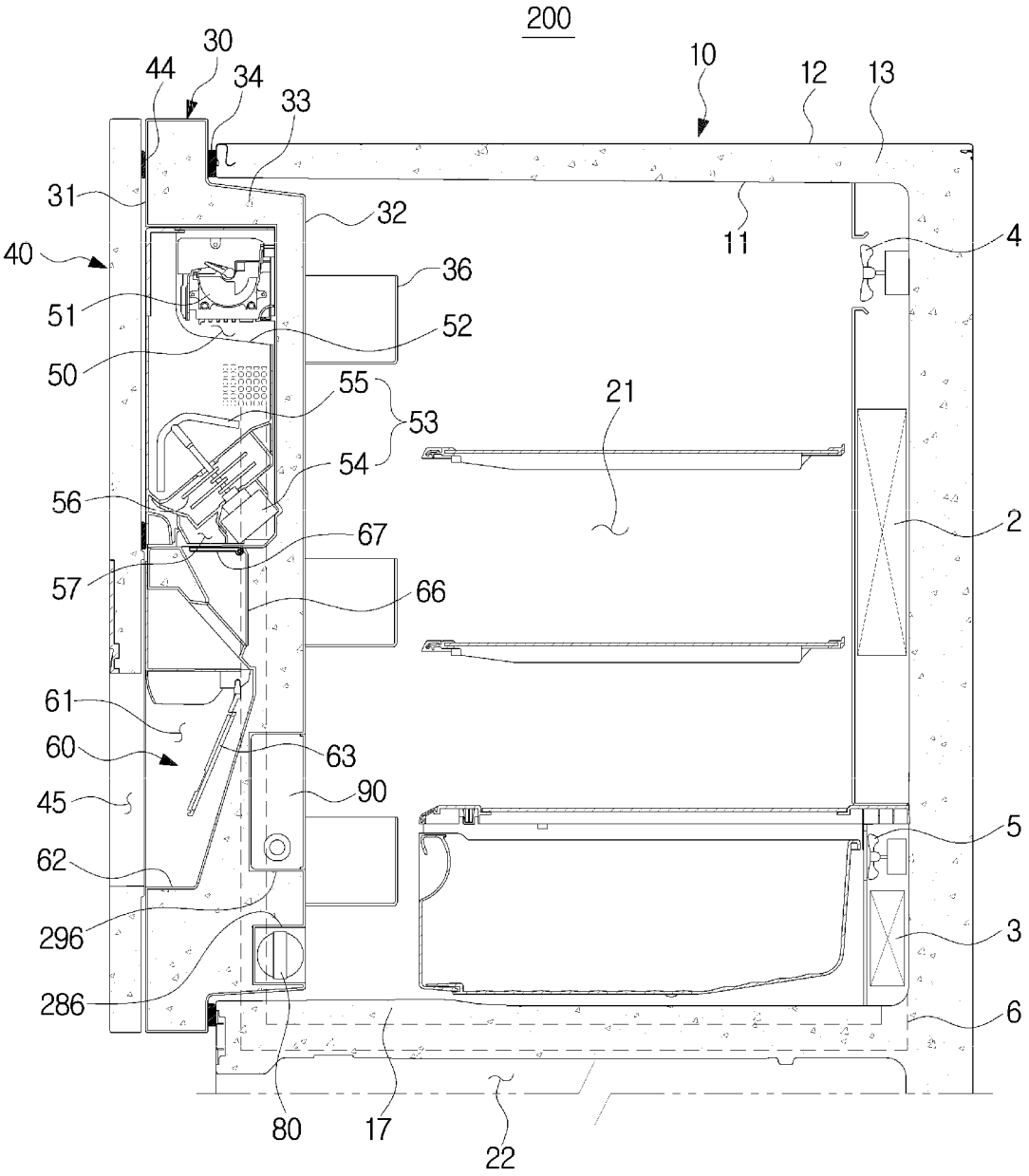
FIG. 6 is a side cross-sectional view schematically illustrating main components of a refrigerator according to a second embodiment of the present disclosure.

FIG. 6 is a side cross-sectional view schematically illustrating main components of a refrigerator according to a second embodiment of the present disclosure. The refrigerator according to the second embodiment of the present disclosure will be described with reference to FIG. 6. The same components as those of the above-described embodiment will be referred to with the same reference numerals, and detailed descriptions thereof will be omitted.

Unlike the above-described embodiment, a water filter accommodation portion 286 may be formed on the rear side of the inner door 30. The water filter accommodation portion 286 may be configured to have an open rear side. Accordingly, it is possible to access the water filter 80 while the inner door 30 is opened.

In this case, the water filter accommodation portion 286 and a water tank accommodation portion 296 may be formed to be integrated. Accordingly, a water supply pipe structure which connects the water filter 80 to the water tank 90 may be more simplified, and a water supply pipe connection operation may be more easily performed.

The water tank accommodation portion 296 which accommodates the water tank 90 may be formed on the rear side of the inner door 30 to communicate with the storage compartment 21.

Figure 7:
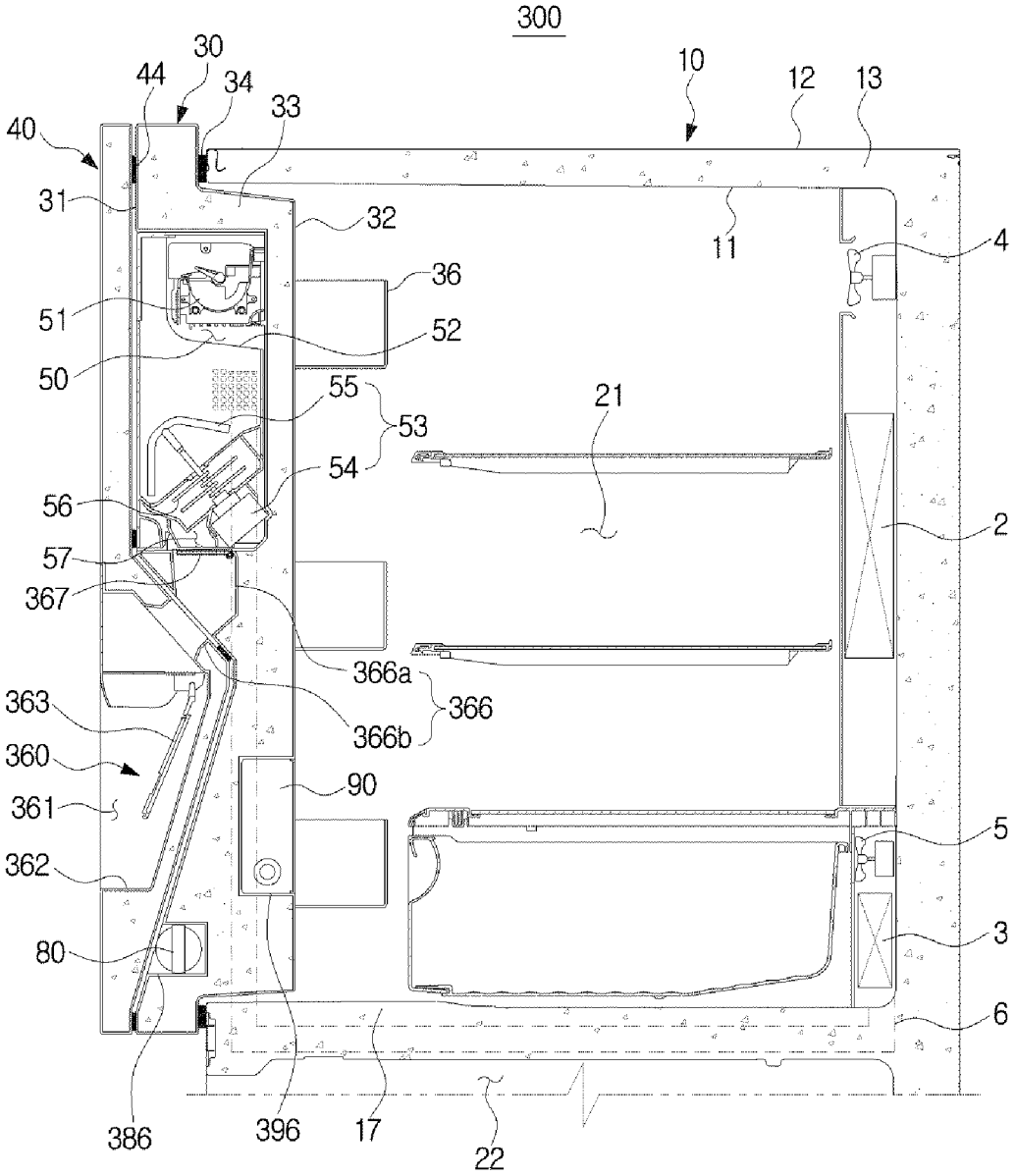
FIG. 7 is a side cross-sectional view schematically illustrating main components of a refrigerator according to a third embodiment of the present disclosure.

FIG. 7 is a side cross-sectional view schematically illustrating main components of a refrigerator according to a third embodiment of the present disclosure. The refrigerator according to the third embodiment of the present disclosure will be described with reference to FIG. 7. The same components as those of the above-described embodiments will be referred to with the same reference numerals, and detailed descriptions thereof will be omitted.

Unlike the above-described embodiments, a dispenser 360 may be included in the outer door 40 rather than in the inner door 30. The dispenser 360 may be formed at a front side of the outer door 40.

The dispenser 360 may include a dispensing space 361 formed to be recessed to receive water and ice, a dispensing tray 362 for disposing a container such as a cup and the like in the dispensing space 361, and a switch 363 for inputting an operation command for the dispenser 60.

A chute 366 configured to connect the ice making chamber 50 to the dispensing space 361 to guide ice in the ice bucket 52 to the dispensing space may include an internal chute **366*a* formed at the inner door 30 and an external chute 366*b* formed at the outer door 40. The internal chute 366*a* and the external chute 366*b* may be configured to communicate with each other when the outer door 40 is closed. An opening or closing member 367 configured to open or close the chute 366 may be provided in the chute 366**.

A water filter accommodation portion 386 may be formed at the inner door 30 to accommodate the water filter 80. The water filter accommodation portion 386 may be formed on the front side of the inner door 30 to be accessible while the inner door 30 is closed and only the outer door 40 is opened. The water filter accommodation portion 386 may be configured to have an open front side.

A water tank accommodation portion 396 which accommodates the water tank 90 may be formed on the rear side of the inner door 30 to communicate with the storage compartment 21.

Figure 8:
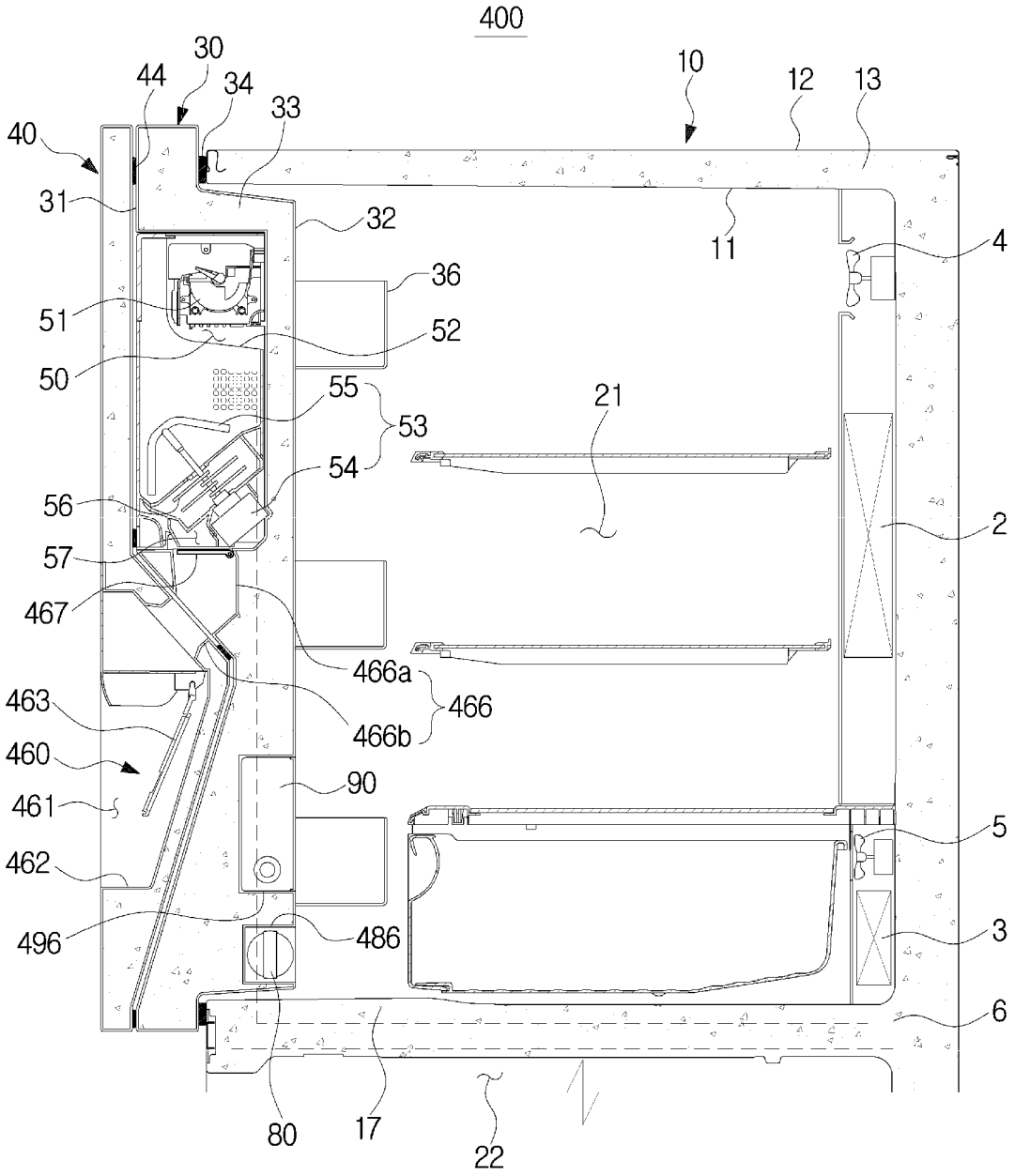
FIG. 8 is a side cross-sectional view schematically illustrating main components of a refrigerator according to a fourth embodiment of the present disclosure.

FIG. 8 is a side cross-sectional view schematically illustrating main components of a refrigerator according to a fourth embodiment of the present disclosure. The refrigerator according to the fourth embodiment of the present disclosure will be described with reference to FIG. 8. The same components as those of the above-described embodiments will be referred to with the same reference numerals, and detailed descriptions thereof will be omitted.

Unlike the above-described third embodiment, a water filter accommodation portion 486 may be formed on the rear side of the inner door 30. The water filter accommodation portion 486 may be configured to have an open rear side. Accordingly, it is possible to access the water filter 80 while the inner door 30 is opened.

A dispenser 460 may be formed at the front side of the outer door 40. The dispenser 460 may include a dispensing space 461 formed to be recessed to receive water and ice, a dispensing tray 462 for disposing a container such as a cup and the like in the dispensing space 461, and a switch 463 for inputting an operation command for the dispenser 60.

A chute 466 may include an internal chute **466*a* formed at the inner door 30 and an external chute 466*b* formed at the outer door 40. The internal chute 466*a* and the external chute 466*b* may be configured to communicate with each other when the outer door 40 is closed. An opening or closing member 467 configured to open the chute 466 may be provided in the chute 466**.

A water tank accommodation portion 496 which accommodates the water tank 90 may be formed on the rear side of the inner door 30 to communicate with the storage compartment 21.

Figure 9:
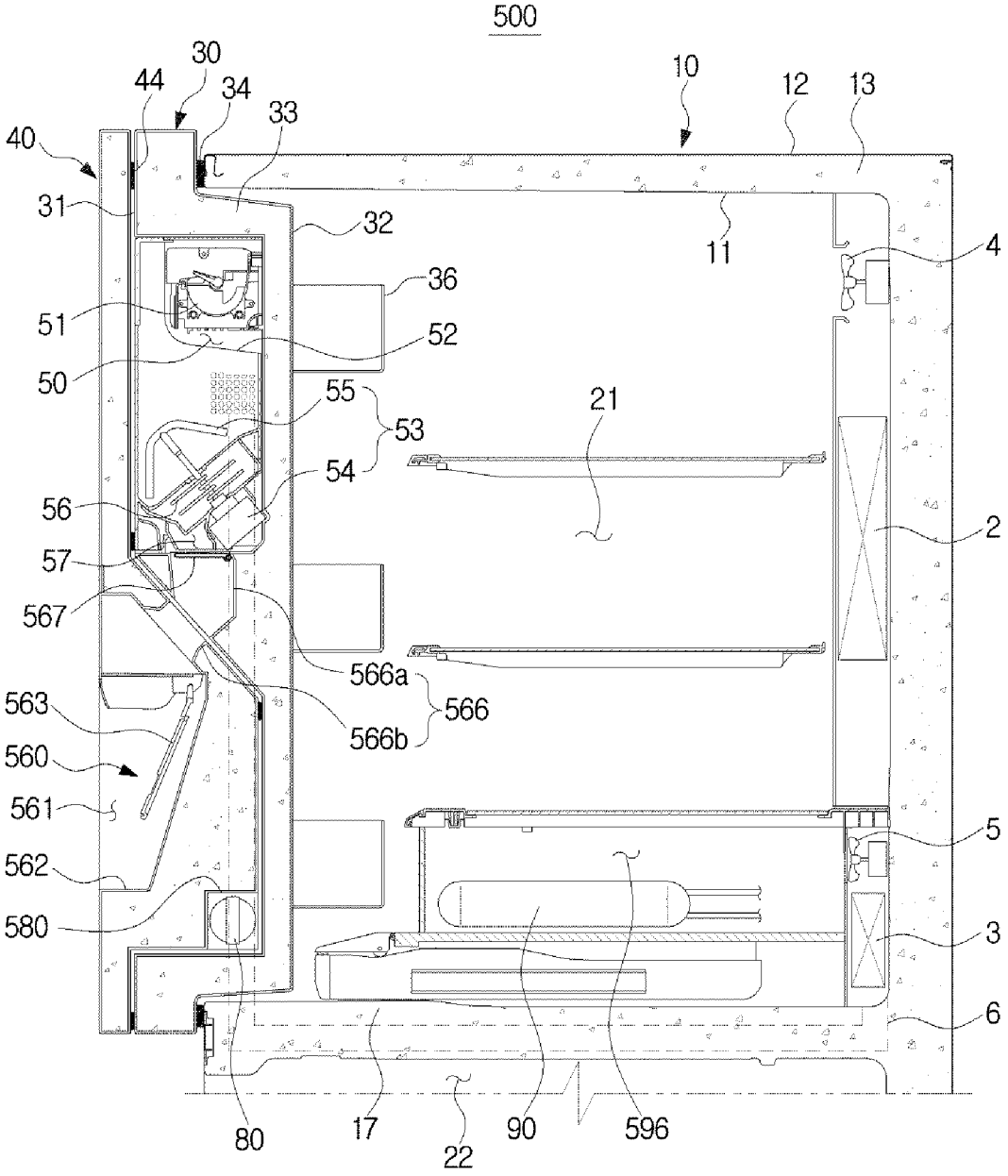
FIG. 9 is a side cross-sectional view schematically illustrating main components of a refrigerator according to a fifth embodiment of the present disclosure.

FIG. 9 is a side cross-sectional view schematically illustrating main components of a refrigerator according to a fifth embodiment of the present disclosure. The refrigerator according to the fifth embodiment of the present disclosure will be described with reference to FIG. 9. The same components as those of the above-described embodiments will be referred to with the same reference numerals, and detailed descriptions thereof will be omitted.

Unlike the above-described embodiments, a water filter accommodation portion 586 which accommodates the water filter 80 may be formed at the rear side of the outer door 40. The water filter accommodation portion 586 may be configured to have an open rear side. Accordingly, it is possible to access the water filter 80 while the inner door 30 is closed and only the outer door 40 is opened.

In this case, a water tank accommodation portion 596 which accommodates the water tank 90 may be formed inside the storage compartment 21 rather than at the inner door 30. The water tank 90 accommodated in the water tank accommodation portion 596 may be kept refrigerated by cold air of the storage compartment 21.

A dispenser 560 may be formed at the front side of the outer door 40. The dispenser 560 may include a dispensing space 561 formed to be recessed to receive water and ice, a dispensing tray 562 for disposing a container such as a cup and the like in the dispensing space 561, and a switch 563 for inputting an operation command for the dispenser 60.

A chute 566 may include an internal chute 566*a* formed at the inner door 30 and an external chute 566*b* formed at the outer door 40. The internal chute 566*a* and the external chute 566*b* may be configured to communicate with each other when the outer door 40 is closed. An opening or closing member 567 configured to open the chute 566 may be provided in the chute 566.

Figure 10:
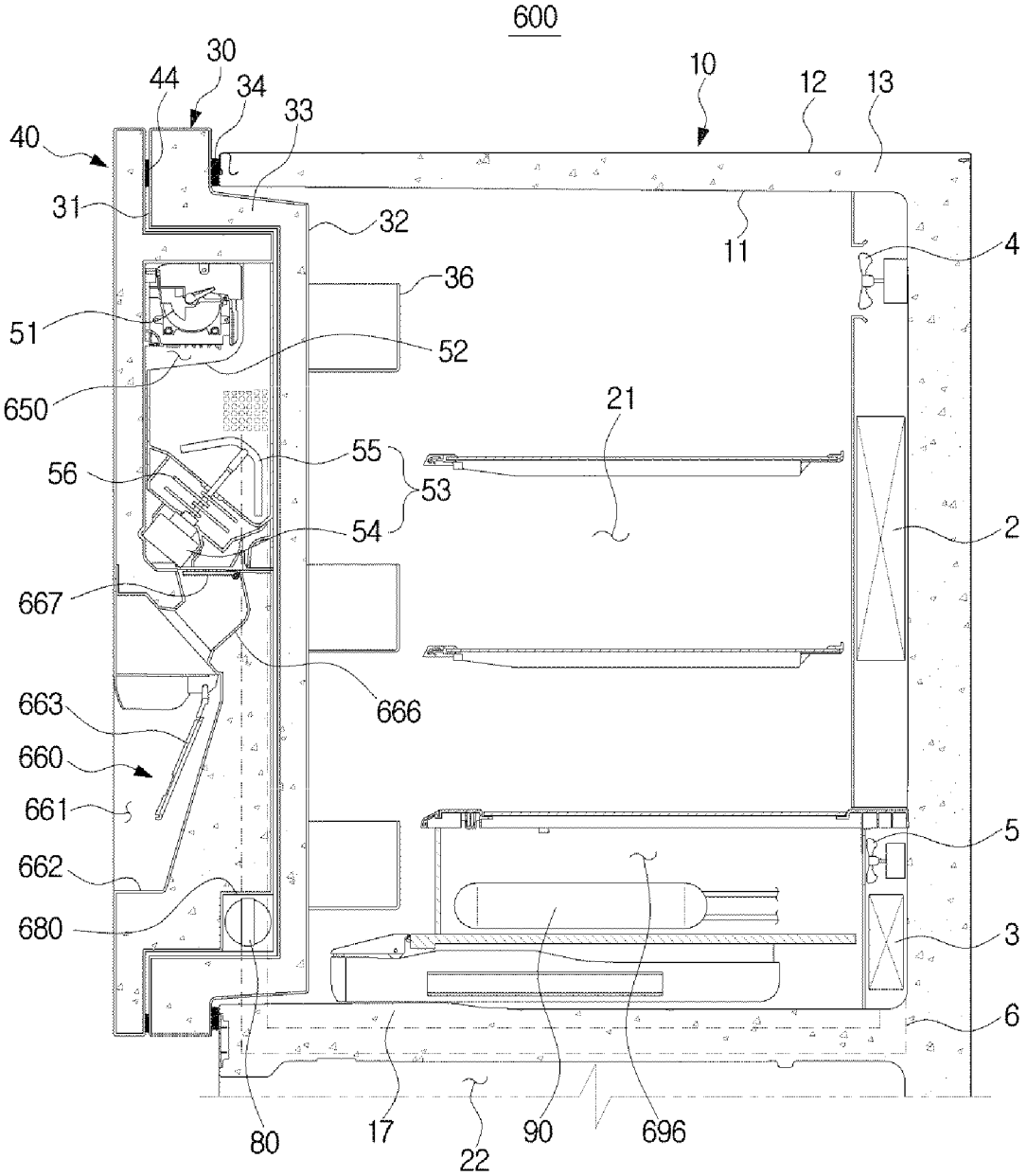
FIG. 10 is a side cross-sectional view schematically illustrating main components of a refrigerator according to a sixth embodiment of the present disclosure.

FIG. 10 is a side cross-sectional view schematically illustrating main components of a refrigerator according to a sixth embodiment of the present disclosure. The refrigerator according to the sixth embodiment of the present disclosure will be described with reference to FIG. 10. The same components as those of the above-described embodiments will be referred to with the same reference numerals, and detailed descriptions thereof will be omitted.

Unlike the above-described embodiments, an ice making chamber 650 may be formed at the rear side of the outer door 40 rather than at the front side of the inner door 30. Accordingly, unlike the above-described embodiments, the ice making chamber 650 may pivot with the outer door 40 when the outer door 40 pivots. An ice making system may be disposed in the ice making chamber 650. The ice making system may include the ice maker 51 configured to make ice by water being put therein to freeze, the ice bucket 52 configured to store the ice made by the ice maker 51, the transfer device 53 configured to transfer the ice stored in the ice bucket 52 to a dispenser 660, and the ice smashing blade 56 provided to smash ice. The transfer device 53 may include the auger motor 54 configured to generate a rotation force and the transfer member 55 configured to receive power from the auger motor 54 and be rotated to stir or transfer ice.

The ice making chamber 650 may be formed to have an open rear side to install the ice making system. The ice making chamber 650 may be divided, separated, and independent from the storage compartment 21 by the inner door 30.

The dispenser 660 may include a dispensing space 661 formed to be recessed to receive water and ice, a dispensing tray 662 for disposing a container such as a cup and the like in the dispensing space 661, and a switch 663 for inputting an operation command for the dispenser 60.

The outer door 40 may include a chute 666 configured to connect the ice making chamber 650 to the dispensing space 661 to guide ice in the ice bucket 52 to the dispensing space 661. An opening or closing member 667 configured to open or close the chute 666 may be provided in the chute 666.

A water filter accommodation portion 686 which accommodates the water filter 80 may be formed at the rear side of the outer door 40. The water filter accommodation portion 686 may be configured to have an open rear side. Accordingly, it is possible to access the water filter 80 while the inner door 30 is closed and only the outer door 40 is opened.

A water tank accommodation portion 696 which accommodates the water tank 90 may be formed in the storage compartment 21. The water tank 90 accommodated in the water tank accommodation portion 696 may be kept refrigerated by cold air of the storage compartment 21.

As is apparent from the above description, since an ice making chamber is provided in front of an inner door, it is possible to easily withdraw ice and maintain and replace an ice maker and an ice bucket by approaching or accessing the ice making chamber without opening the inner door.

Since the inner door remains in a closed state while the ice making chamber is approached or accessed, cold air in a storage compartment may not flow out.

Since a water filter configured to purify water is provided at a door portion and a water supply pipe configured to connect an external water supply source to the water filter is connected to the water filter through a hinge member of the door portion, a water supply structure may be simplified.

Although particular embodiments have been described to explain the technical concept of the present disclosure, the scope of the present disclosure is not limited to the embodiments. It should be appreciated by those skilled in the art that changes may be made in these embodiments without departing from the principles and spirit of the disclosure, the scope of which is defined in the claims and their equivalents.

What is claimed is:

1. A refrigerator comprising:

a body including a storage compartment;

an inner door pivotably coupled to the body to open or close the storage compartment;

an outer door pivotably provided in front of the inner door;

a water filter accommodated in a water filter accommodation portion which is horizontally elongated between the inner door and the outer door;

an ice making chamber in the inner door so as to be divided from the storage compartment by the inner door;

an ice making system accommodated in the ice making chamber to make ice with water filtered by the water filter;

a water tank in the inner door to store water filtered by the water filter;

a dispenser including a dispensing space in the inner door through which to provide filtered water stored by the water tank and ice made by the ice making system, and a switch in the inner door to operate the dispenser; and a water supply pipe within the inner door and configured to supply water filtered by the water filter from the water filter to the water tank and from the water filter to the ice making system, wherein the dispenser is accessible through an opening of the outer door while the inner door and the outer door are closed, the ice making chamber and the water filter are accessible while the inner door is closed and the outer door is opened, and the outer door covers the ice making chamber and the water filter accommodation portion while the outer door is closed, such that the ice making system and the water filter are inaccessible.

2. The refrigerator of claim 1, wherein the ice making system comprises an ice maker provided in the ice making chamber to make ice, an ice bucket configured to store the ice, and an auger motor configured to stir or transfer the ice stored in the ice bucket.

3. The refrigerator of claim 1, further comprising:

a gasket provided between the inner door and the outer door to seal the ice making chamber.

4. The refrigerator of claim 1, further comprising:

a hinge pivotably coupling the inner door to the body, wherein the water supply pipe passes through the hinge and is configured to guide the water supplied from an external water supply source to the water filter.

5. The refrigerator of claim 4, wherein the hinge comprises a hinge shaft, the inner door comprises a hinge groove in which the hinge shaft is inserted, the inner door is configured to pivot with respect to the hinge shaft, and the hinge shaft comprises a through hole through which the water supply pipe passes.

6. The refrigerator of claim 1, wherein the refrigerator includes a chute configured to connect the ice making chamber to the dispensing space to guide ice in the ice making chamber to the dispensing space, the chute is comprised by an internal chute formed at the inner door and an external chute formed at the outer door, and the internal chute and the external chute are configured to communicate with each other when the outer door is closed.

7. A refrigerator comprising:

a body including a storage compartment;

an inner door pivotably coupled to the body to open or close the storage compartment;

an outer door having an opening and being pivotably provided in front of the inner door:

a water filter accommodation portion horizontally elongated between the inner door and the outer door, in which a water filter is accommodatable to filter water supplied from an external water supply source;

an ice making chamber in a front side of the inner door so as to be divided from the storage compartment by the inner door;

an ice making system accommodated in the ice making chamber to make ice with water filtered by the water filter when the water filter is accommodated in the water filter accommodation portion;

a water tank in the inner door to store water filtered by the water filter when the water filter is accommodated in the water filter accommodation portion;

a dispenser including a dispensing space in the front side of the inner door through which to provide filtered water stored by the water tank and ice made by the ice making system, and a switch in the front side of the inner door to operate the dispenser;

a water supply pipe within the inner door and configured to, with the water filter accommodated in the water filter accommodation portion, supply water filtered by the water filter from the water filter to the water tank and from the water filter to the ice making system, wherein the outer door is pivotable to a closed position in which the outer door covers the ice making chamber and the water filter accommodation portion, so that the ice making chamber and the water filter, when the water filter is accommodated in the water filter accommodation portion, are inaccessible from in front of the outer door, and the dispenser is accessible from in front of the outer door through the opening, and an opened position in which the ice making chamber and the water filter, when the water filter is accommodated in the water filter accommodation portion, are accessible from in front of the inner door.

8. The refrigerator of claim 7, further comprising:

a hinge configured to pivotably couple the inner door to the body, wherein the water supply pipe is connected to the water filter through the hinge.

9. The refrigerator of claim 1, wherein the outer door is pivotably coupled to the inner door or to the body so that the outer door pivots to the opened position or the closed position while the inner door closes the storage compartment.

10. The refrigerator of claim 7, further comprising:

a water filter cover that is detachably provided on an opened front side of the water filter accommodation portion.

11. The refrigerator of claim 1, further comprising:

a water filter cover that is detachably provided on an opened front side of the water filter accommodation portion.

12. The refrigerator of claim 1, wherein the water filter accommodation portion longitudinally extends horizontally between the inner door and the outer door.

13. The refrigerator of claim 7, wherein the water filter accommodation portion longitudinally extends horizontally between the inner door and the outer door.

* * * * *